US008806821B1

(12) United States Patent
Brown

(10) Patent No.: US 8,806,821 B1
(45) Date of Patent: Aug. 19, 2014

(54) TOWER FOUNDATION PILLAR SLAB AND METHOD OF PRODUCING SUCH

(71) Applicant: Franklin Brown, Clarkesville, GA (US)

(72) Inventor: Franklin Brown, Clarkesville, GA (US)

( * ) Notice: Subject to any disclaimer, the term of this patent is extended or adjusted under 35 U.S.C. 154(b) by 0 days.

(21) Appl. No.: 13/933,808

(22) Filed: Jul. 2, 2013

Related U.S. Application Data

(63) Continuation-in-part of application No. 13/786,033, filed on Mar. 5, 2013, and a continuation-in-part of application No. 13/757,400, filed on Feb. 1, 2013.

(51) Int. Cl.
*E02D 27/32* (2006.01)
*E02D 27/42* (2006.01)

(52) U.S. Cl.
USPC ..... 52/295; 52/292; 52/294; 52/298; 52/296; 52/297; 264/233

(58) Field of Classification Search
USPC ..... 52/292, 294, 295, 296, 297, 298; 264/233
See application file for complete search history.

(56) References Cited

U.S. PATENT DOCUMENTS

| | | | | |
|---|---|---|---|---|
| 178,438 | A | | 6/1876 | Hill |
| 1,033,887 | A | | 7/1912 | Griffin |
| 1,069,328 | A | | 8/1913 | Griffin |
| 1,447,942 | A | | 3/1923 | Fitzgerald |
| 1,529,895 | A | | 3/1925 | Chance et al. |
| 1,600,895 | A | | 9/1926 | Larry et al. |
| 1,647,925 | A | | 11/1927 | May |
| 2,282,251 | A | | 5/1942 | Schwendt |
| 2,367,146 | A | | 1/1945 | Siebs |
| 2,373,798 | A | | 4/1945 | Williams |
| 2,374,624 | A | | 4/1945 | Schwendt |
| 2,381,014 | A | | 8/1945 | Thornley |
| 2,917,901 | A | | 12/1959 | Lackner |
| 3,579,935 | A | | 5/1971 | Regan et al. |
| 3,653,168 | A | | 4/1972 | Cook |
| 3,956,862 | A | | 5/1976 | Alexandre, Jr. |
| 4,190,384 | A | | 2/1980 | Neumann |
| 4,512,685 | A | | 4/1985 | Hegle |
| 4,592,678 | A | | 6/1986 | McNinch, Jr. et al. |
| 4,672,782 | A | | 6/1987 | Richter et al. |
| 4,704,052 | A | | 11/1987 | Aubert |
| 4,769,964 | A | | 9/1988 | Johnson et al. |
| 4,783,935 | A | | 11/1988 | Creager |
| 4,915,888 | A | * | 4/1990 | Sato ..... 264/71 |
| 5,031,376 | A | | 7/1991 | Bender et al. |
| 5,231,808 | A | | 8/1993 | Angelette |
| 5,257,489 | A | * | 11/1993 | Angelette ..... 52/295 |
| 5,533,835 | A | * | 7/1996 | Angelette ..... 405/229 |
| 5,746,036 | A | * | 5/1998 | Angelette ..... 52/295 |
| 6,141,936 | A | | 11/2000 | Butler, Jr. |
| 6,176,055 | B1 | | 1/2001 | Fu |
| 6,216,403 | B1 | | 4/2001 | Belbeoc'h |
| 7,827,748 | B2 | | 11/2010 | Brown |

FOREIGN PATENT DOCUMENTS

| | | |
|---|---|---|
| NL | 8004538 | 3/1982 |

* cited by examiner

*Primary Examiner* — Mark Wendell
(74) *Attorney, Agent, or Firm* — Baker Donelson; Dorian B. Kennedy

(57) ABSTRACT

A tower foundation (10) has a base slab (11), pillar slabs (12), and a crown stab (13), all of which are made of precast concrete structures. The pillar slab is formed with a unitary mold (40) with one continuous internal chamber (41) which includes multiple leg cavities (42) which have three sidewalls (43) that are all angled outwardly from the bottom of the mold to the top of the mold. The mold produces a pillar slab which has multiple legs (12') wherein each of the three sidewall surface (46) of each leg is set at an angle a.

2 Claims, 3 Drawing Sheets

TOWER FOUNDATION PILLAR SLAB AND METHOD OF PRODUCING SUCH

REFERENCE TO RELATED APPLICATION

This is a continuation-in-part of U.S. patent application Ser. No. 13/786,033 filed Mar. 5, 2013 which is a continuation-in-part of U.S. patent application Ser. No. 13/757,400 filed Feb. 1, 2013.

TECHNICAL FIELD

This invention relates to foundation slabs, and particularly to foundation pillar slabs and a method of forming pillar foundation slabs.

BACKGROUND OF THE INVENTION

Today there exists a vast number of towers, such as cellular telephone towers, railroad communication tower utilizing microwave, radio and satellite communications, and tilt-down towers, being erected across the country. Each tower includes a foundation embedded within the ground which prevents the tower for toppling over.

In the past, these foundations have been constructed by merely digging a hole in the ground and filling the hole with concrete to which the upright towers is anchored. This has been costly in that it requires that mixed concrete in fluid form be transported to each site, requires a curing time to pass before the next step of the process can be complete, thereby slowing the construction process and increasing costs, and requires a time or inspection delay between construction events which can cause days of delays to occur.

More recently, foundations have been made of a series of precast concrete components. The precast concrete components include large slabs with holes therethrough through which guide rods extend that coupled the slabs together. A problem with these slabs has been that the guide rods tend to move slightly or vibrate with the passage of nearby trains or other vehicles or due to environmental forces upon the tower such as wind and rain. This movement can cause the guide rods to chip or wear against the hole. Additionally, the bolts threaded onto the top's of the guide rods and against the slab may also wear upon the concrete surface, thereby causing a loosening of the bolt on the guide rod and against the concrete slab.

Another problem associated with precast tower foundations is that they include a large central passageway through the crown slab that does not always align with a space within the lower slabs. As such, electrical conduits associated with the equipment mounted to the tower coupled to the foundation are not always easily passed through the crown slab or are compressed between the foundation slabs.

Lastly, another problem associated with these precast tower foundations is that in some foundations the middle slabs are designed to include multiple legs which extend radially from a center of the foundation, typically foundations include four such legs. These slabs are often referred to as spiders. Because these slabs include multiple legs, the slabs have been formed by interlocking two separate blocks together at their center to form an X-shape in the horizontal plane, as shown in U.S. Pat. No. 5,231,808, which is incorporated herein by reference.

Accordingly, it is seen that a precast tower foundation crown slab that overcomes or alleviates the just described problems is needed. It is to the provision of such therefore that the present invention is primarily directed.

SUMMARY OF THE INVENTION

A tower foundation pillar slab comprises a concrete body portion having a plurality of legs extending radially from a center, each leg having a first end surface, a second end surface opposite the first end surface, a plurality of guide rod mounting holes extending between the second end surface and the first end surface, and a plurality of sidewall surfaces extending between the first end surface and the second end surface. Each of said plurality of sidewalls surfaces being angled so that oppositely disposed sidewall surfaces converge towards each other as they extend between the first end surface and the second end surface.

A method of manufacturing a tower foundation pillar slab comprising the steps of (a) providing a unitary mold having a plurality of leg cavities, each mold leg cavity being tapered along all sidewall surfaces as the cavity extends upwardly from one end of the mold to an opposite end of the mold; (b) pouring concrete into the mold; (c) allowing the concrete to cure within the mold to form a pillar slab, and (d) extracting the cured pillar slab from the mold without disjoining the sidewalls of the unitary mold.

DETAILED DESCRIPTION

Figure 1:
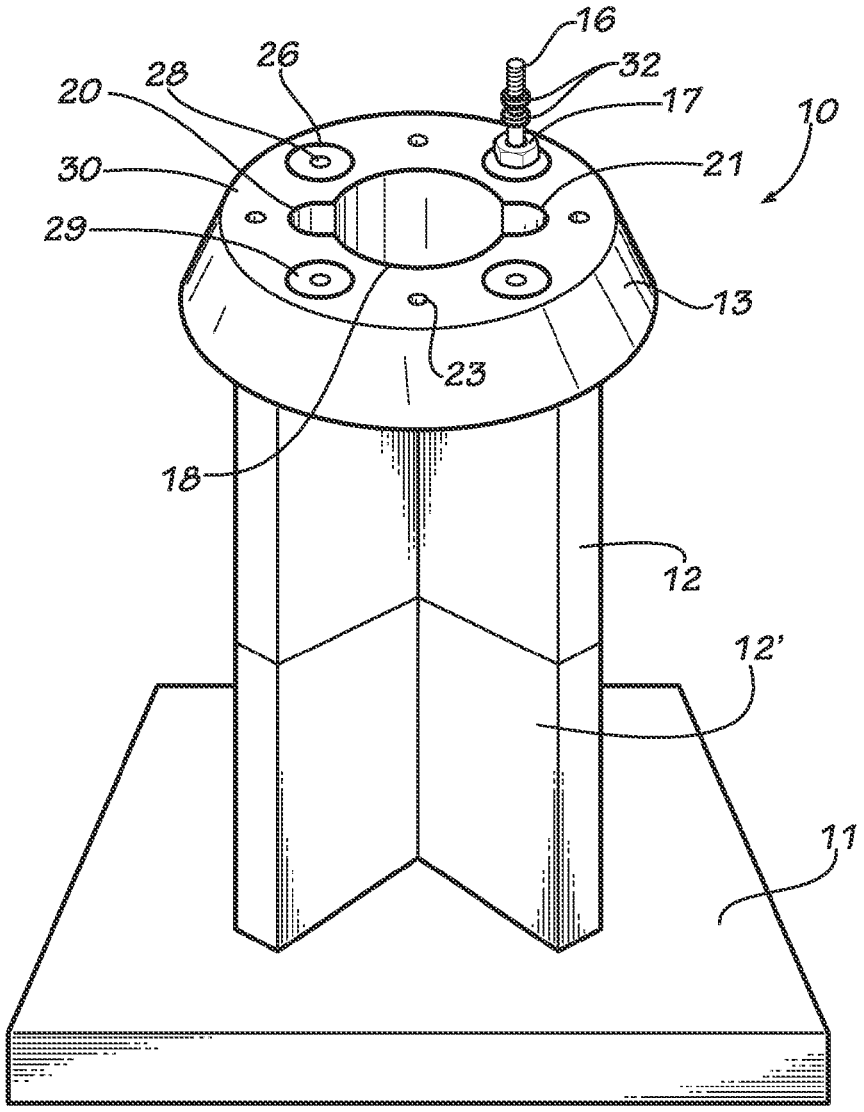
FIG. 1 is a perspective view of a tower foundation embodying principles of the invention in a preferred form.
Figure 4:
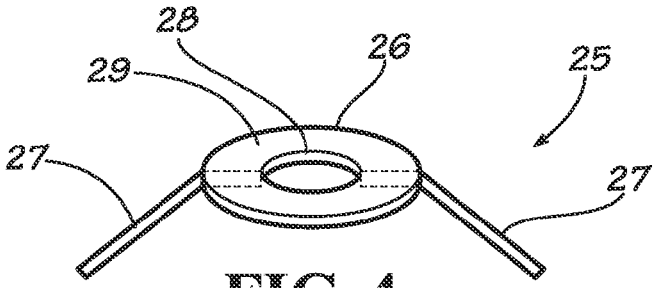
FIG. 4 is a perspective view of the compression washer assembly of the tower foundation of FIG. 1.

With reference next to the drawing, there is shown a tower foundation 10 of the present invention in a preferred form. The foundation here has a base or bottom slab 11, a plurality of pillar or middle slabs 12, and a crown or top stab 13, all of which are made of precast concrete structures. A pillar slab having multiple legs rather than being a monolith or flat slab is referred to herein as a multi-legged pillar slab or spider. The base slab 11, pillar slabs 12 and crown slab 13 are all retained in position by four steel guide rods 15 that extend upwardly from the base slab 11. The four guide rods 15 have externally threaded ends 16 configured to receive internally threaded mounting nuts 17. The guide rods 15 are arranged in a generally square pattern.

Figure 2:
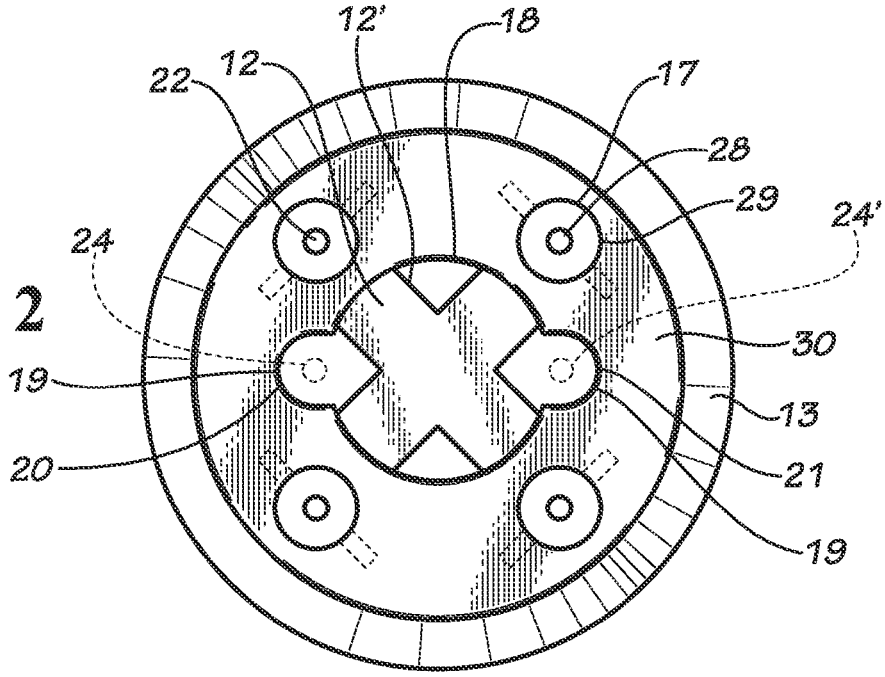
FIG. 2 is a top view of the crown slab of the foundation of FIG. 1.
Figure 3:
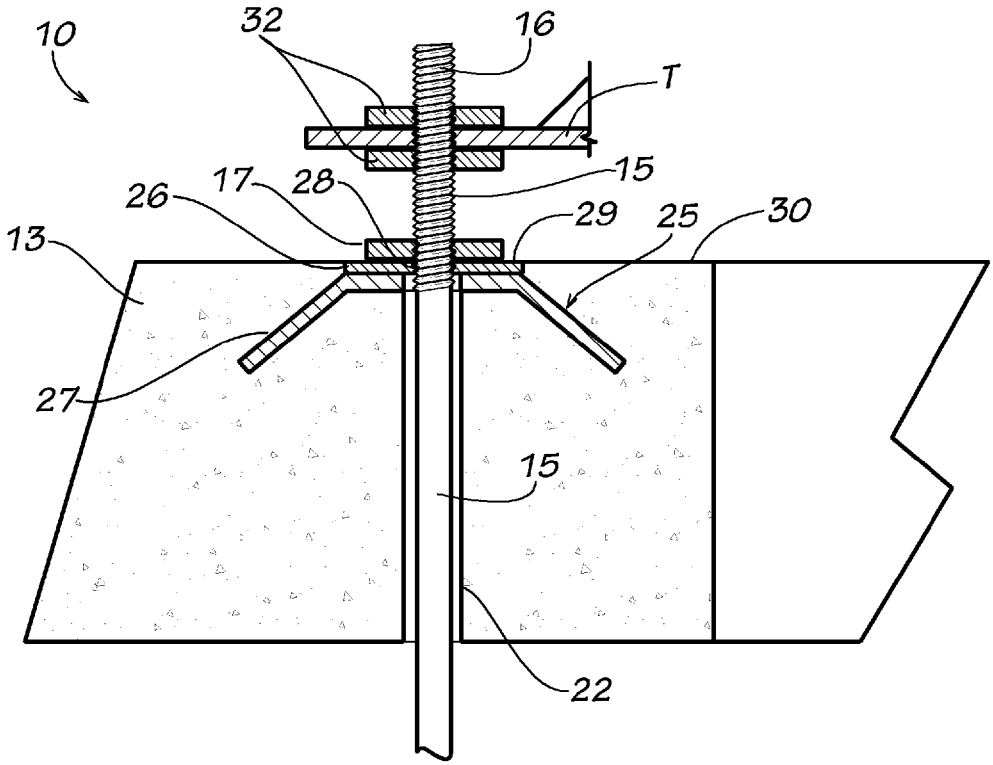
FIG. 3 is a cross-sectional view of the crown slab of a portion of the foundation of FIG. 1.

The base slab 11, pillar slabs 12 and crown slab 13 are manufactured in molds shown and described in detail in U.S. Pat. No. 5,257,489, which is specifically incorporated herein. The molds have side wall surfaces that are tapered which results in the slabs sides being tapered. The prior art multi-legged pillar slabs were formed by having a slab which comprised two oppositely disposed legs and a central notch coupled with another inverted like slab so that the notches are positioned together, thereby interlocking the two separate pillar slabs together (similar to log cabin designs of interlocking logs) and forming a multi-legged pillar slab having four distinct and separate legs. Alternatively, the prior art showed multi-legged pillar blocks being formed with multiple piece molds, as shown in FIG. 2B of U.S. Pat. No. 5,746,036. These multi-pieced molds must be assembled prior to the concrete being poured into the mold, and then disassembled after the concrete is cured in order to extract the newly formed multi-legged pillar slab from the mold. This assembly and disassembly of the mold with the formation of each and every multi-legged pillar slab is time consuming and inefficient.

Figure 6:
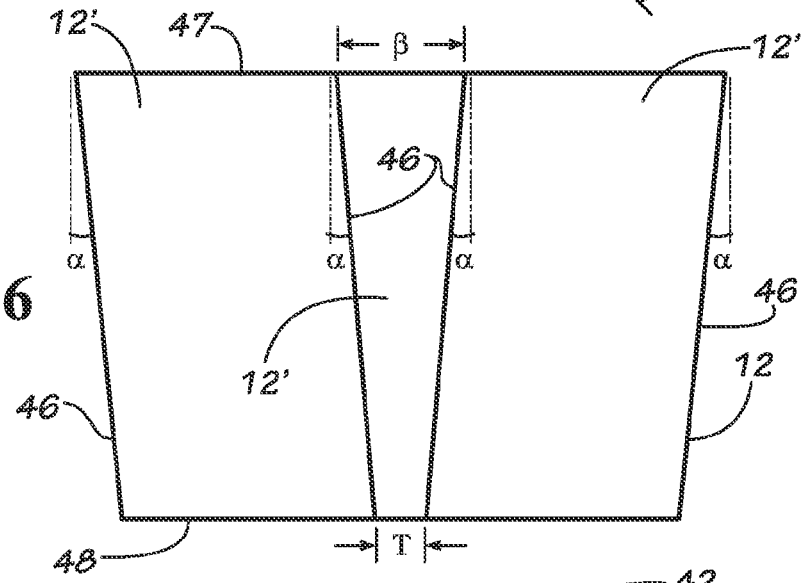
FIG. 6 is a side view of the pillar slab of the foundation of FIG. 1.
Figure 7:
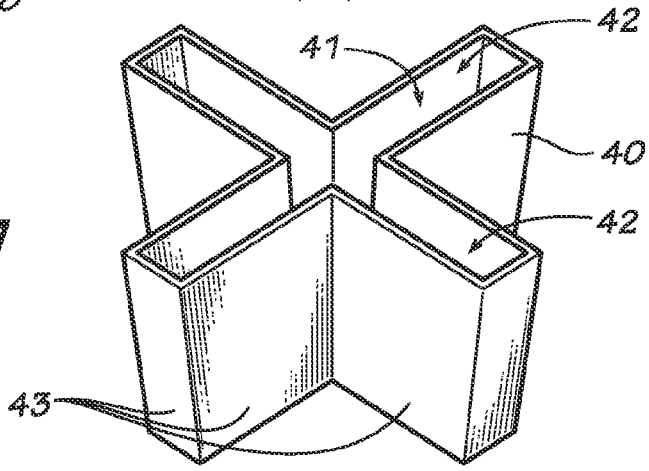
FIG. 7 is a perspective view of a mold used to form the pillar slab of the foundation of FIG. 1.

A new method of manufacturing multi-legged pillar slabs 12 is to utilize a unitary mold 40 with one continuous internal chamber 41 which includes multiple leg cavities 42 each having three sidewalls 43. Each of the three sidewalls 43 is angled outwardly from the bottom of the mold to the top of the mold, as shown in FIG. 7. The mold 40 produces a pillar slab 12 which has multiple legs 12' wherein each of the three sidewall surface 46 of each leg 12' is set at an angle a, as shown in FIG. 6, so that each leg 12' tapers downwardly from the top end 47 to the bottom end 48. Preferably, the sidewalls of the mold, and thus the resulting pillar slab, are set at an angle so that the sidewalls move inwardly approximately one inch over the height or vertical course of a twenty four inch pillar slab.

The pillar slab 12 is formed with this tapered mold 40 by inserting a structural grid or frame into the mold 40 and then pouring concrete into the mold through the open top. The structural frame includes lifting inserts into which a removable lifting eye may be threaded. Once the concrete has cured to a point where the pillar slab 12 can be removed, through mechanical lift means, such as a crane, is coupled to the lifting eyes and the pillar slab is lifted and thereby extracted from the mold. The mold is treated with a releasing agent, such as vegetable oil, prior to the pouring of the concrete to prevent or restrict the concrete from bonding with the mold.

Figure 5:
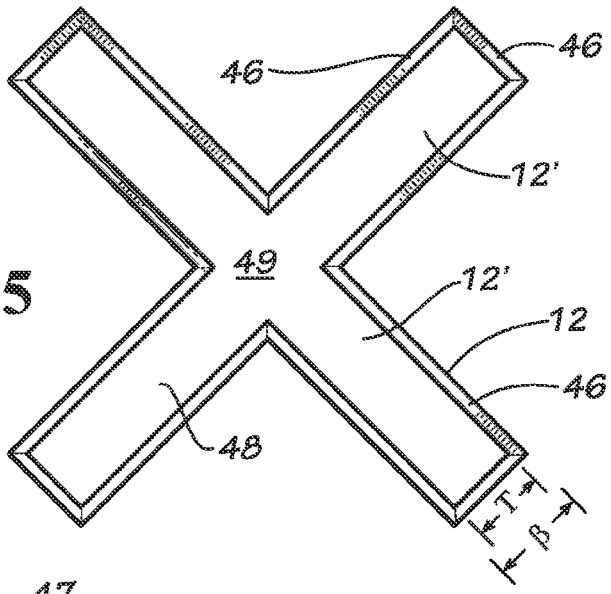
FIG. 5 is a bottom view of the pillar slab of the foundation of FIG. 1.

As shown in FIG. 5, which is a bottom view of the pillar slab 12, the pillar slab has four legs 12' extending from a center 49. Each leg 12' top end or surface 47 has a select width T and sidewalls or sidewall surfaces 46 which narrow, taper, or converges as they extend toward the bottom end or surface 48, which has a select width B which is smaller than top end surface select width T. It should be understood that all three sidewall surfaces 46 of each leg 12' are angled or tapered in this manner.

The pillar slab 12 made in this manner can extend in one piece to a greater unitary (one piece) height than the prior art pillar slabs formed on interlocking slabs. This one piece construction also eliminates the dangerous situation of having to manually position these extremely heavy interlocking slabs together to form a pillar slab, an endeavor which could result in the workers fingers being crushed between converging slabs during assembly.

Once made, the base slab 11 is of an extremely strong and rigid construction. It also has four guide rod mounting holes that extend down to four anchor plates to which guide rods 15 are mounted. The four guide rods 15 are then mounted to the base slab 11.

The tapered pillar slabs 12 are generally X-shaped (four legs 12') and rest upon the base slab 11. The pillar slabs 12 have four guide rod mounting holes extending therethrough positioned to be aligned with the guide rods 15. The pillar slabs 12 are mounted on the four guide rods 15 atop the base slab 11.

Finally, the crown slab 13 is mounted atop the pillar slabs 12. The concrete crown slab 13 has a body portion with four guide rod mounting holes 22 extending therethrough through which the guide rods 15 extend. The crown slab also includes four unshown eye bolts extending from eye bolt mounting holes 23 and embedded inserts within the top surface. The crown slab 13 has a generally circular central passageway 18 with two oppositely disposed, semi-circular cut-outs or ancillary channels 19 extending outwardly therefrom. The ancillary channels 19 are designated an incoming conduit ancillary channel 20 and an outgoing conduit ancillary channel 21, the actual designation of which being an incoming or an outgoing is immaterial to the invention. The incoming conduit ancillary channel 20 receives the incoming electrical conduit 24 associated with electrical wiring going to (coupled to the input of) the electrical components of the tower, while the outgoing conduit ancillary channel 21 receives the outgoing electrical conduit 24' associated with electrical wiring coming from (coupled to the output of) the electrical components of the tower. It should be noted that the ancillary channels 19 are oriented to be directly over the space between adjacent legs 12' of the X-shaped pillars, so that the electrical conduits 24 and 24' extend between the legs 12' of the X-shaped pillars (within the space between adjacent legs 12') and into the ancillary channels. Thus, the ancillary channels prevent the conduits from becoming pinched, crushed or chaffed between or against adjacent slabs.

The crown slab 13 also has four compression washer assemblies 25 partially embedded therein. Each compression washer assembly 25 includes a metal pressure plate, main plate, or washer 26 and a pair of oppositely disposed mounting or anchor legs 27 mounted to the pressure washer 26. The pressure washer 26 has a central mounting hole 28 coaxially aligned with the crown slab guide rod mounting holes 22 through which the guide rod extends. The pressure washer 26 has a top surface 29 which is positioned generally coplanar or flush with the top surface 30 of the crown slab and therefore exposed from the top. The anchor legs 27 are embedded within the crown slab to provide reinforcement and stability.

With this construction, the slabs 11, 12 and 13 are assembled with the guide rods extending through each slab's mounting holes and extending past the top surface 30 of the crown slab 13. This construction allows the weight of the tower to be dissipated through the pressure washer 26 and into the rest of the foundation, rather than being loaded upon the guide rods and solely to the base of the foundation. The threaded mounting nuts 17 are then threaded onto the rods to a position wherein they are in direct contact with and bear tightly against the top surface 29 of the pressure washer 26. As such, the mounting nuts 20 bear against a solid metal plate like structure. Thus, the mounting nut no longer bears against concrete which is susceptible to chipping or wearing due to vibrations or other types of movement. The elimination of the concrete wearing problem enables the nut 20 to be better secured and the tower foundation to be more rigid and therefore safer in initial construction as well as over an extended period of time.

The threaded top ends 16 of the guide rods extend past the top surface 30 of the crown slab 13. A tower T, or the like, is then coupled to the top end 16 and secured in place on each rod by a pair of tower mounting nuts 32. The relative positions of the tower mounting nuts 32 along the guide rod 15 may be adjusted to level the tower.

The pillar slabs here are generally rectangular in shape. The foundation of FIG. 1 has a base slab 11 that measure four feet by four feet and a height of six inches. Once the foundation is placed in the ground and the dirt is packed tightly around the foundation the dirt is pressed tightly against the sidewalls of the pillar slabs.

Typically, the foundation of FIG. 1 is used to support cellular towers or the like, but may be used for any type of tower, signage, signal or other device. As such, the term tower foundation is not meant to be a limitation, but merely a description of one use of structure used in conjunction with the foundation.

It should be understood that any number and peripheral shape of pillar slabs may be utilized with the present invention, the number and size of slabs depends on the size and weight of the slabs and on the size, height and weight of the tower coupled thereto. Also, it should be understood that the base and crown slabs may also be configured to having tapered sidewalls.

It should be understood that while the preferred embodiment described the pressure washer top surface as being mounted "flush" with the top surface of the crown slab, slight variations should be included in the term "flush". As such, the term "flush" should also include slight or small variations between these two top surfaces and should not be construed strictly as exactly coplanar.

It should be understood that the term unitary mold is intended to denote a mold which is designed to allow the slab made therein to be extracted after curing without having break down the mold into multiple pieces, i.e., without having the separate the mold sidewalls (take apart into pieces) like the mold shown in FIG. 2B of U.S. Pat. No. 5,746,036. As such, unitary molds may include molds which are made of multiple pieces which are joined together so long as those multiple pieces are not intended or required to be separated or disjoined in order to extract the slab from the mold.

It should be understood that while the pillar slab 12 is shown tapering from the top to the bottom, it may also be oriented in an opposite or inverted manner with the tapering being from the bottom to the top when assembled as a tower.

It thus is seen that a tower foundation is now provided that overcomes problems long associated with those of the prior art. It should be understood however that many modifications, additions and deletions may be made to the embodiments specifically described without departing from the spirit and scope of the invention as set forth in the following claims.

The invention claimed is:

1. A tower foundation pillar slab comprising a concrete body portion having a plurality of legs extending radially from a center, each said leg having a first end surface, a second end surface opposite said first end surface, a plurality of guide rod mounting holes extending between said second end surface and said first end surface, and at least three sidewall surfaces extending between said first end surface and said second end surface, all of said at least three sidewall surfaces of each said leg being angled so that oppositely disposed said sidewall surfaces of each leg of said plurality of legs of said tower foundation pillar slab converge towards each other as they extend between said first end surface and said second end surface.

2. A method of manufacturing a tower foundation multi-legged pillar slab comprising the steps of:

(a) providing a unitary mold having a plurality of leg cavities, each mold leg cavity being tapered along all mold leg cavity sidewall surfaces as the cavity extends upwardly from one end of the mold to an opposite end of the mold;

(b) pouring concrete into the mold;

(c) allowing the concrete to cure within the mold to form a pillar slab, and (d) extracting the cured pillar slab from the mold without disjoining the mold leg cavity sidewalls of the unitary mold to produce a multi-legged pillar slab having each leg tapered along all sidewalls surfaces so that the pillar slab leg sidewall surfaces are angled to converge towards each other.

* * * * *